US006311345B1

(12) United States Patent
Limbach

(10) Patent No.: US 6,311,345 B1
(45) Date of Patent: Nov. 6, 2001

(54) METHOD FOR INCORPORATING A BASIN IN A RECEIVING PLANE, RESULTING MONOBLOC ASSEMBLY FOR FURNITURE IN PARTICULAR BATHROOM OR KITCHEN FURNITURE

(76) Inventor: Christian Limbach, 158 rue du General de Gaulle, 57050 Longeville les Metz (FR)

( * ) Notice: Subject to any disclaimer, the term of this patent is extended or adjusted under 35 U.S.C. 154(b) by 0 days.

(21) Appl. No.: 09/674,827

(22) PCT Filed: Apr. 22, 1999

(86) PCT No.: PCT/FR99/00961

§ 371 Date: Nov. 7, 2000

§ 102(e) Date: Nov. 7, 2000

(87) PCT Pub. No.: WO99/57383

PCT Pub. Date: Nov. 11, 1999

(30) Foreign Application Priority Data

May 7, 1998 (FR) ..... 98 05818

(51) Int. Cl.[7] ..... E03C 1/33
(52) U.S. Cl. ..... 4/632; 4/630; 4/635
(58) Field of Search ..... 4/619, 630–636, 4/660; 29/428, 434, DIG. 1

(56) References Cited

U.S. PATENT DOCUMENTS 1,778,300 * 10/1930 Ramstead ..... 4/630
3,247,588 4/1966 Duke .

FOREIGN PATENT DOCUMENTS 904 229 5/1986 (BE) .
0 026 236 4/1981 (EP) .
0 307 825 3/1989 (EP) .
0 471 964 2/1992 (EP) .
2 729 169 7/1996 (FR) .
8 201 555 11/1983 (NL) .

* cited by examiner

*Primary Examiner*—Gregory L. Huson
*Assistant Examiner*—Tuan Nguyen

(57) ABSTRACT

A method of integrating a basin into a receiving plane, in particular a plane for sanitary fittings or a worktop in a piece of bathroom or kitchen furniture. The method consists in disposing and fixing the basin (3) in an opening in the receiving plane (9) in such a way that the edge of the opening (11–14) is held in a rabbet between the peripheral mouth of the basin (6–8) and a lower shoulder of polymerized resin (19) connecting and caulking the basin and the receiving plane over the entire circumference at the bottom part.

14 Claims, 5 Drawing Sheets

Figure 1:
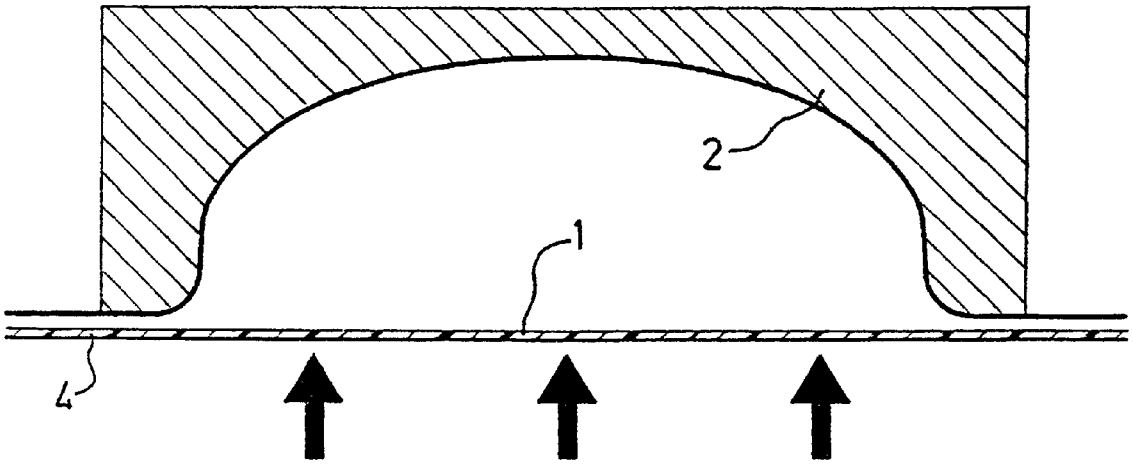

Fig 9
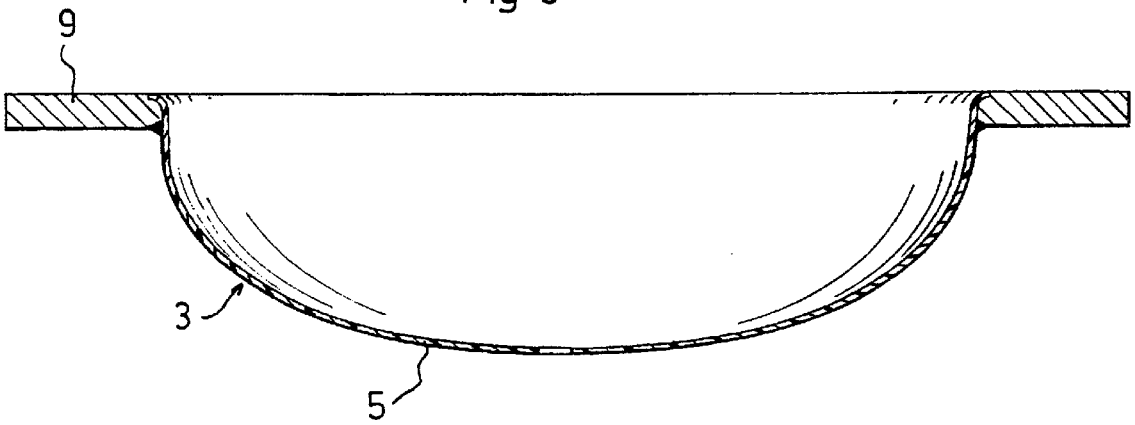
Fig 10
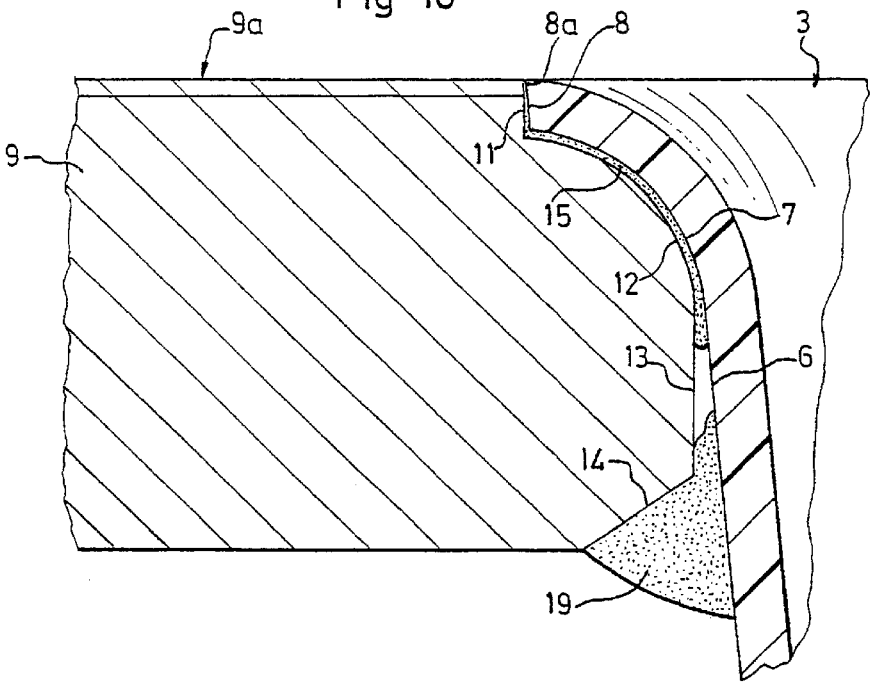
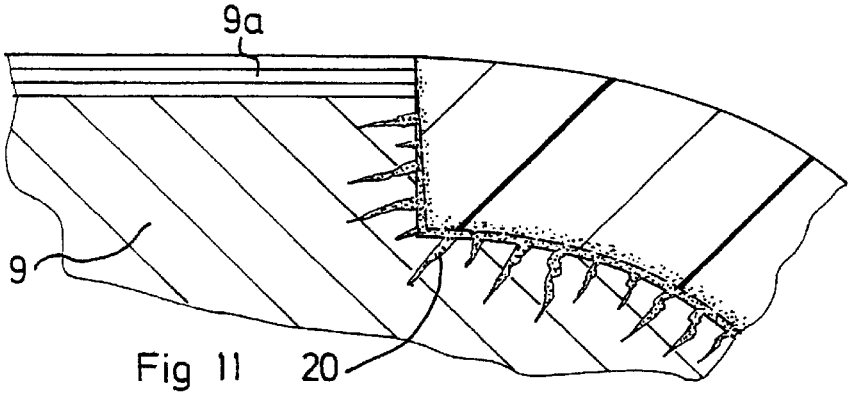
Fig 11

METHOD FOR INCORPORATING A BASIN IN A RECEIVING PLANE, RESULTING MONOBLOC ASSEMBLY FOR FURNITURE IN PARTICULAR BATHROOM OR KITCHEN FURNITURE

The invention relates to a method of integrating a basin into a receiving plane, in particular a plane for sanitary fittings or a worktop in bathroom or kitchen furniture. It extends to the monobloc receiving-plane/ basin assembly obtained.

Bathroom or kitchen furniture possesses an upper panel forming a plane for sanitary fittings or a worktop into which a basin, generally a sink-basin or wash-basin, is fitted; this upper panel may be clad with a coating (in particular made of laminate) and is often designated by the term "receiving plane". Two types of technique make it possible to integrate the basin into the receiving plane. After an opening has been made in the latter, the basin can be placed in position in the said opening, either below the receiving plane or above the latter. In the first case, the operations for fixing the basin are more complex, and imperfect installation can lead, when the basin is in use, to displacement of the latter in relation to the receiving plane, in particular to separation under the weight of the load or even to breaking-away.

The method to which the invention relates is of the second type in which the basin is placed in position in the opening in the receiving plane above the latter. Thanks to an overlapping peripheral border, the basin can be fitted above the upper surface of the receiving plane so as to project in relation to the said surface (EP-0471964; FR-2729169, FIG. 5); it may also be fitted in a moulding formed in the receiving plane around the opening so as to ensure that the basin is flush with the level of the upper surface of the receiving plane (EP-0307825; FR-2729169, FIG. 6). This flush fitting of the basin has the advantage of ensuring surface continuity between the basin and the receiving plane, thus avoiding accumulations of contaminants and facilitating cleaning. In both cases, the basin inserted in the opening in the receiving plane in this way is stabilised by means of a number of fixing components of a mechanical type (pinching or gripping components) which are disposed on the periphery of the receiving plane at the bottom part of the latter.

Such a method of integration has a number of shortcomings. In the first place, the need to place a number of fixing components in position around the basin appreciably increases the installation costs by reason of the actual cost of these accessories and the cost of fitting them. Moreover, the connection between the basin and the receiving plane remains imperfect in the case of this type of fixing: the basin, which is held, at its bottom part, at a distance from the receiving plane at a number of points, may undergo minor displacements in relation to the said receiving plane, particularly in the event of impacts. When a flush fit is being sought between the upper surface of the receiving plane and the basin, an integrating and fixing mode of this kind does not enable perfect continuity of the surfaces to be obtained, and the aesthetic quality of the assembly remains imperfect; in particular, minor displacements of the basin have a considerable effect on the quality of appearance of the assembly.

A variant for integrating a sink in a support is described in Patent NL 8,201,555. The sink is placed in the receiving plane at a certain distance from the latter so as to form a clear peripheral space intended to constitute a moulding volume for an elastomer (especially polyurethane); the assembly is disposed, in the upside-down position, on an air bolster which closes the moulding volume at the level of the working face of the receiving plane, and the elastomer is cast into this volume in order to serve as a connecting and damping buffer. However, such an embodiment has the same shortcomings as before as far as the quality of fixing of the sink and the quality of appearance of the finished product are concerned. The flow of elastomer into the moulding volume generally contains bubbles (originating from the trapping of air when casting is carried out) which affect the quality of the fixing. Moreover, a major peripheral joint remains apparent on the utility face of the finished product, thereby breaking the continuity between the basin and the receiving plane; this joint ages in the course of time, with the risks of variation in colouring and accumulation of stains. Moreover, at the time of manufacture (before the casting of the elastomer), the basin is difficult to position perfectly in relation to the receiving plane and a shortcoming in positioning leads to a very defective aesthetic quality in the finished product (basin off-centre and surrounded by a joint of variable thickness).

The present invention proposes to alleviate the above-mentioned shortcomings of the known methods of integration of the type providing, in the upper part, flush fitting of the basin and receiving plane.

One object of the invention is, in particular, to supply a receiving-plane/basin assembly which, once produced, forms an indissociable monobloc element, without any possibility or risk of displacement of the basin in relation to the receiving plane.

Another object is to obtain, for the said assembly, a finished appearance of remarkable quality with, in particular, perfect basin/receiving-plane continuity at the level of the upper surface of the said receiving plane.

Another object is to indicate a method which does not call for mechanical fixing accessories and the implementation of which may be carried out at the factory at a reduced cost compared to the known methods.

With a view to making the description clearer, it will be assumed, throughout the following, that the receiving plane and basin are in their normal position of use, the terms "top", "bottom", "upper" and "lower" referring to this position.

The method according to the invention for integrating a basin into a receiving plane is characterised in that it combines the following operations:

(a) the basin is produced by moulding a synthetic material, with a peripheral mouth comprising a portion which is widened out towards the top, followed by a rounded portion terminating in an upper rim of centrifugal direction and of predefined diameter, (b) The receiving plane is bored right through and an opening for the insertion of the basin is produced in the said plane, the said opening comprising, edgewise:
   - in its top part, an upper offset matched to the upper rim of the basin and of a height which is suitable for permitting the encasing of the said upper rim of the basin in the said offset with little clearance,
   - in its intermediate part, a convex rounded formation matched to the rounded portion of the basin so as to be capable of being applied, with little clearance, against the said rounded portion, the said convex rounded formation being followed by a so-called "decompression" section, which is arranged to arrive opposite the widened-out portion of the basin so as to form a decompression chamber with the said portion, c) a fine layer of polymerisable glue is deposited at the level of the upper offset and of at least part of the rounded formation on the receiving plane, d) the basin is then placed in position in the opening in the receiving plane so that its upper rim and its rounded portion become enchased opposite the upper offset and the rounded formation on the receiving plane respectively, e) the said basin is pushed in, compressing the fine layer of polymerisable glue, in such a way that the upper rim of the basin becomes flush with the upper surface of the receiving plane, the compression having the effect of making the thickness of the polymerisable glue compressed between the matched surfaces thinner and uniform, and being accompanied by a flow of glue towards the decompression chamber delimited by the widened-out portion of the basin and by the decompression section of the receiving plane.

According to a preferred mode of implementation, the boring of the opening in the receiving plane (b) is carried out so as to endow the said opening, in its lower part, with a supporting face (14) for casting a shoulder, the method comprising a final operation (f) consisting in casting a shoulder of polymerisable resin at the level of this supporting face, between the said supporting face and the basin so as to produce a continuous peripheral connection between these elements, thereby ensuring the caulking thereof over the entire periphery.

As will be better understood later on, a method of this kind makes it possible to manufacture an indissociable monobloc receiving-plane/basin assembly without any mechanical component, it being possible to produce this assembly at the factory at low cost. There is no need to fear any relative movement between the basin and receiving plane which is liable to affect the aesthetic character of the assembly. The mode in which the basin is placed in position leads to precise enchasing of the upper rim and the rounded portion of the basin opposite the offset and the convex rounded formation on the receiving plane respectively, and makes it possible to obtain perfect flush fitting of the said basin in the said receiving plane in the upper part, and highly aesthetic continuity of the surfaces. The basin and the opening in the receiving plane are preferably produced in such a way that the upper rim and the rounded portion of the basin have shapes which are matched to those of the offset and of the convex rounded formation on the receiving plane respectively, with a clearance of between 0.1 mm and 0.7 mm. It should be noted that the precise positioning is permitted by the definition of the matched surfaces of the basin and receiving plane, which are produced so as to follow one another's shape closely, and by the presence of the decompression chamber which, on the one hand, receives the majority of the excess glue driven out when compression occurs and, on the other hand, makes it possible to carry out the casting of the shoulder at the bottom part under satisfactory conditions.

According to a preferred mode of implementation, which contributes to the obtention of a finished appearance of high quality, the basin is pushed into the opening in the receiving plane by means of a conforming jig closely following the shape of the upper surface of the basin mouth and of the receiving plane so as to guide the positioning of the basin in the opening until the upper rim of the basin is flush with the upper surface of the said receiving plane. This conforming jig leads to very precise positioning of the basin at the end of the pushing-in operation and makes it possible to obtain, after setting, a regular glue joint over the entire periphery of the basin at the level of its rounded portion and of its upper rim; the outer arris of the upper rim of the basin is brought, with great precision, into the same plane as the upper surface of the receiving plane.

The conforming jig may be fixed onto the basin by any means, or simply laid on the latter. At the end of the pushing-in operation, it is kept in place on the receiving plane, until the glue sets, by any means (a press, gripping components, jacks, the application of a pneumatic pressure, etc.).

After the glue has set, the joint between the basin and the receiving plane is levelled so as to eliminate overflows of glue above the upper surface of the said receiving plane. This finishing operation may be performed by means of a levelling knife of conventional type, or may consist in cleaning by means of a solvent.

The basin may be made of thermoplastic material and produced by thermoforming; in that case, the peripheral mouth of the basin is formed with a peripheral extension which is then machined in order to produce the upper rim of the mouth with a precise diameter corresponding, apart from the clearance, to that of the offset in the receiving plane. According to a preferred mode of implementation, the basin is moulded in acrylic material, the polymerisable glue and the polymerisable resin of the shoulder being likewise of the acrylic type, so as to produce a weld at the level of the basin (surface fusion of the basin before setting).

The basin may also be manufactured by injection into a mould which conforms it directly to the predefined shapes.

The invention extends to the monobloc receiving-plane/basin assembly obtained by implementation of the method, as a new product. In particular, according to an advantageous mode of embodiment, the receiving plane of the said assembly possesses an opening whose edge, which is provided with an upper offset, an intermediate rounded formation and a lower supporting face, is held in a rabbet by the basin between, on the one hand, the peripheral mouth of the latter, which mouth is endowed with a rounded portion and with an upper rim of centrifugal direction, and on the other hand, a lower shoulder of polymerised resin which connects and caulks the basin and the receiving plane over the entire circumference at the bottom part.

Figure 2:
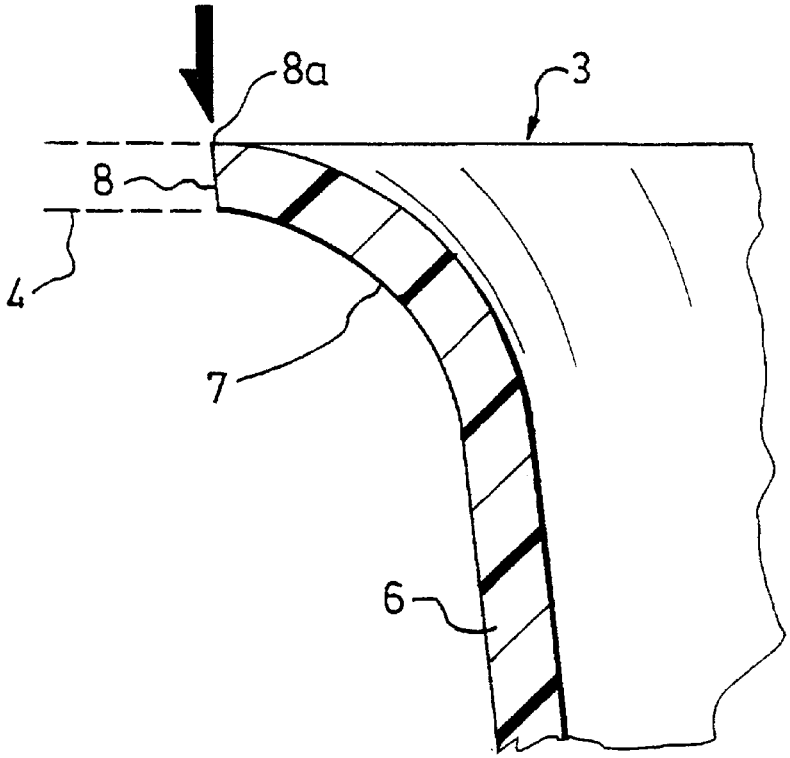
Figure 3:
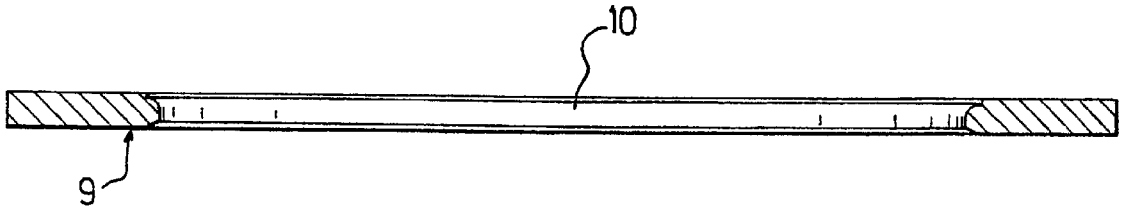
Figure 4:
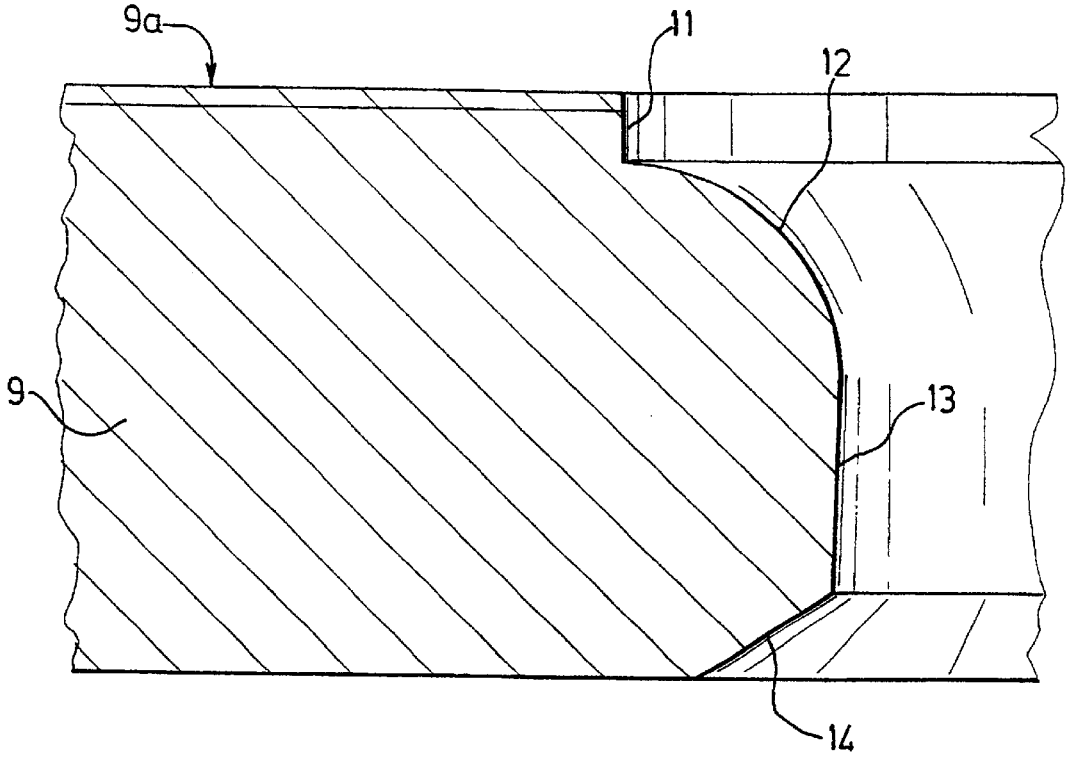
Figure 5:
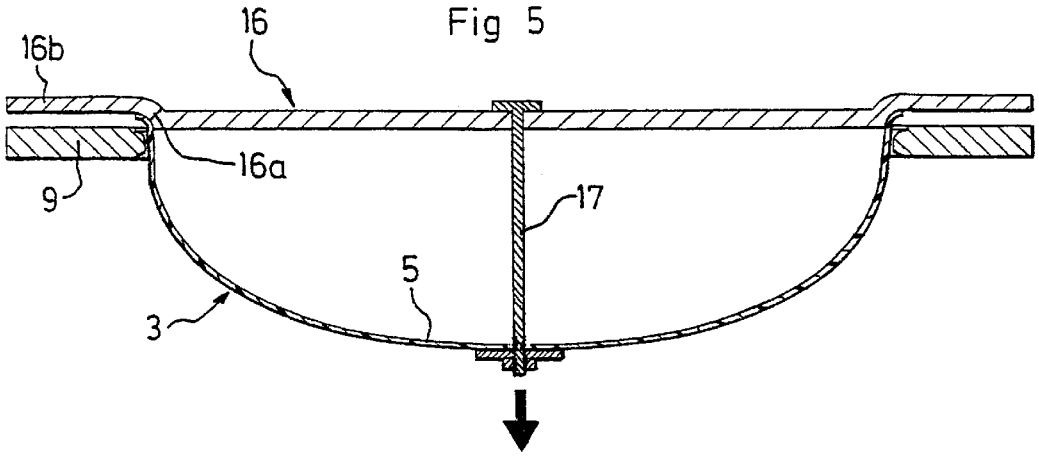
Figure 6:
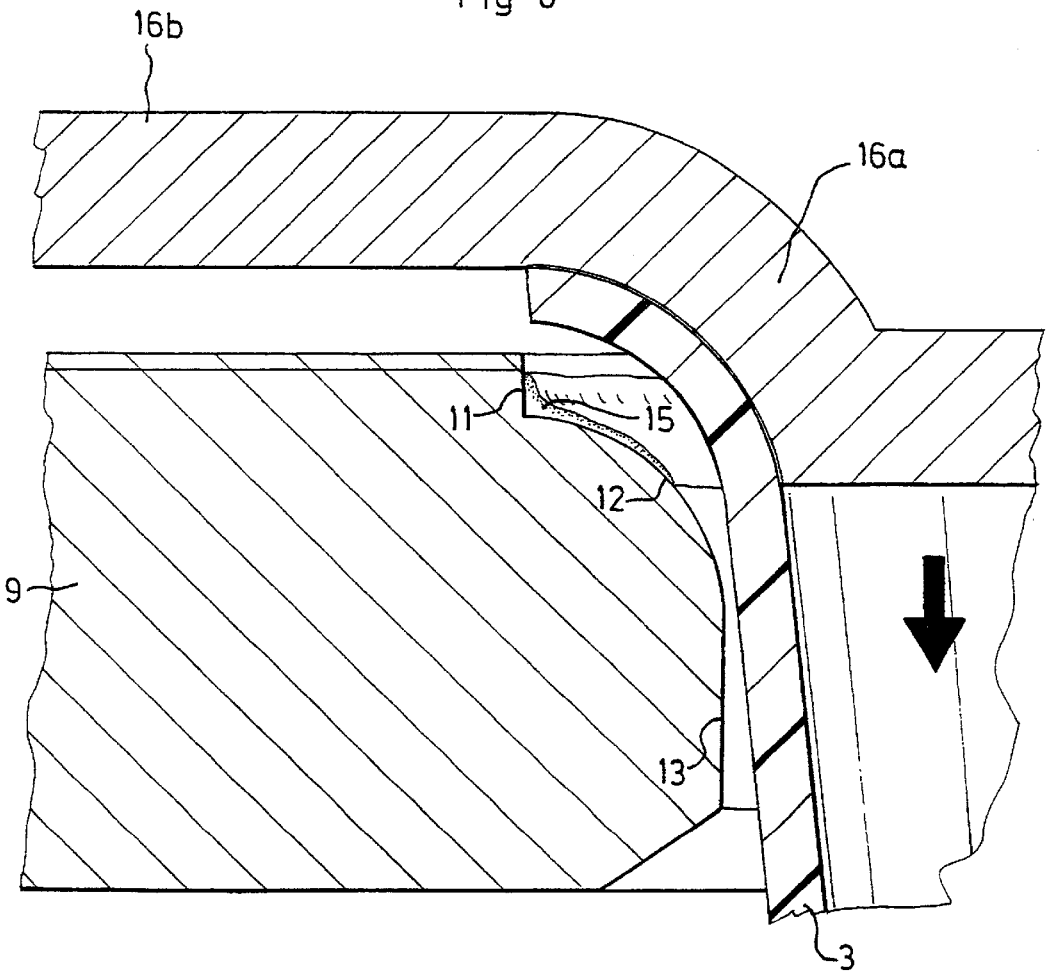
Figure 7:
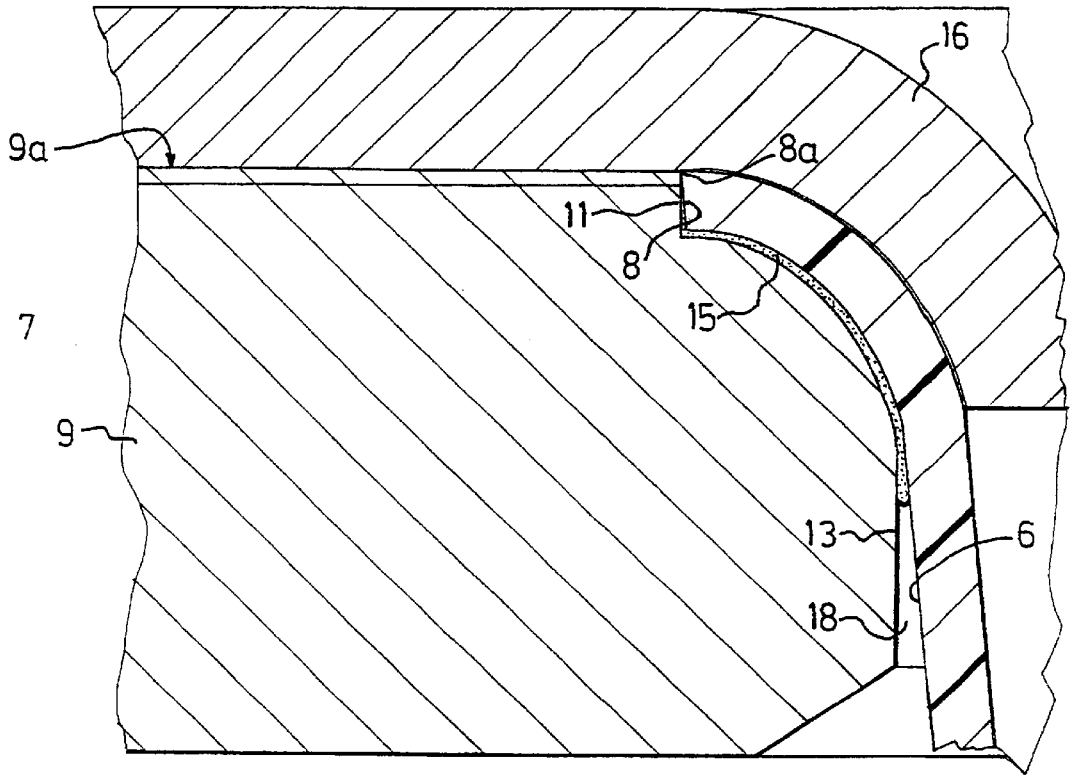
Figure 8:
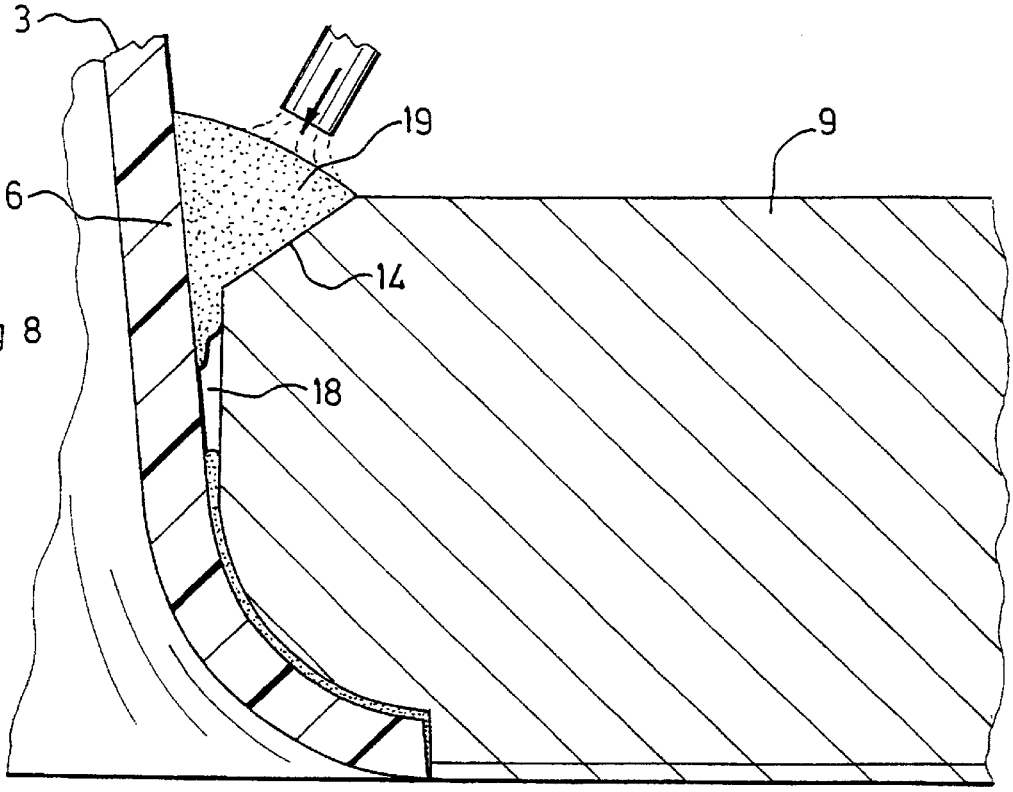

Other characteristics, aims and advantages of the invention will emerge from the following description in conjunction with the appended drawings which show a mode of implementation of the method as a non-limitative example; in the said drawings:

FIG. 1 schematises, in section, a basin in the course of thermoforming,

FIG. 2 is a detail section, on an expanded scale, of the basin obtained, illustrating the operation of machining its peripheral mouth, FIG. 3 schematises, in general section, a receiving plane after the machining of the opening, FIG. 4 is a detail view, on an expanded scale, of the said receiving plane, FIG. 5 illustrates the placing in position of the basin in the opening in the receiving plane, after the deposition of a layer of polymerisable glue, FIG. 6 is a detail section, on an expanded scale, illustrating this placing-in-position operation, FIG. 7 illustrates the position of the basin after being pushed into the opening in the receiving plane, FIG. 8 schematises the formation of the lower shoulder between the basin and the receiving plane (the assembly being turned over for this operation), FIG. 9 is a general view, in section, of the assembly obtained, FIG. 10 is a partial section, on an expanded scale, and FIG. 11 is a detail section on a greatly enlarged scale.

The thermoforming operation schematised as an example in FIG. 1 is, in itself, conventional. A sheet 1 made of thermoformable acrylic material is shaped by pneumatic pressure in a mould 2 having a shape matched to that of the basin 3 to be obtained, which will be described later on. At the peripheral border, the basin comprises a flat extension 4 which is pinched between the mould and countermould during the thermoforming operation.

The basin 3 comprises a bottom 5 of conventional type (generally pierced by a drain hole) and a peripheral side which possesses a mouth composed, as illustrated in FIG. 2, of a portion which is widened-out towards the top 6 and is, in the example, substantially frustoconical in shape, and of a rounded portion 7 orientated towards the outside and terminating in an upper rim 8 of centrifugal direction. This rim is prolonged by the flat extension 4 which extends in a horizontal direction (that is to say, one which is orthogonal to the axis of the basin).

After cooling, the basin 3 is machined on a numerical-control machine in order to cut off the extension 4 and produce the upper rim 8 which is of a precise shape and diameter. This cutting-off operation is preferably carried out in such a way that the rim 8 has an edge which is very slightly inclined in an undercut and is positioned substantially at the points of contact between the rounded portion 7 and horizontal planes, as illustrated in FIG. 2.

A basin 3 of precise, predefined shape is obtained in this way. Naturally, other types of moulding (injection, etc.) may be used in order to obtain such a basin.

The receiving plane 9 schematised in FIGS. 3 and 4 is a panel made of any material which is customarily used in this type of application (composite material, wood, glued lamellate, marble, granite, etc.). In the example represented, this panel is made of fibreboard produced from wood-based waterproof particles and coated with a decorative coating made of laminate, whose surface 9*a* will constitute the visible upper surface of the finished product.

This panel is bored right though and subjected to machining on a numerical machine with a view to forming, in the said panel, an opening 10 whose peripheral edge possesses, as illustrated in FIG. 4, an upper offset 11 matched to the upper rim 8 of the basin, a convex rounded formation 12 matched to the rounded portion 7 of the basin, a so-called "decompression" section 13 which, in the example, is of substantially cylindrical shape, and a lower supporting face 14 constituted, in the example, by a peripheral fillet formed at the level of the lower arris of the receiving plane.

The upper offset 11 and convex rounded formation 12 are machined in a manner corresponding with the upper rim 8 and rounded portion 7 of the basin, so that their respective shapes are matched, with a clearance of between 0.1 mm and 0.7 mm, with a view to the subsequent formation of a very thin glue joint with a thickness of less than 0.7 mm.

FIGS. 5 and 6 illustrate the operation of depositing a fine layer of polymerisable glue 15 on the edge of the receiving plane, and the operation of placing the basin in position in the latter.

The glue used is, in particular, a thermosetting glue of acrylic type which is suitable for penetrating into the open cells of the agglomerated structure and for producing a weld with the acrylic material of the basin by surface fusion of the latter. The thin layer of acrylic glue is deposited at the level of the offset 11 and in the upper part of the rounded formation 12.

The basin 3 is presented by means of a conforming jig 16 at the level of the opening 10 in the receiving plane. The conforming jig is intended to permit very precise placing in position of the basin in the opening. This conforming jig comprises a zone 16*a* which closely follows, in the form of a hollow, the shape of the upper surface of the mouth of the basin, and a flat peripheral zone 16*b* which is intended to come to rest on the upper surface 9*a* of the receiving plane at the end of the pushing-in operation.

This conforming jig may, in particular, be fixed on the basin by a threaded rod 17 which passes through the drain hole in the said basin.

As FIG. 7 illustrates, at the end of the pushing-in operation, the decompression section 13 of the receiving plane and the widened-out portion 6 of the basin delimit a decompression chamber 18 having a bevel-shaped cross-section which broadens out towards the bottom. The glue 15 is compressed by the basin and forms a glue joint of low, uniform thickness substantially corresponding to the clearance between the receiving plane and the basin; the excess glue flows towards the decompression chamber 18. It should be emphasised that the guidance performed by this jig guarantees remarkable regularity of the glue joint all round the mouth of the basin, and precise positioning of the upper rim 8 of the basin, the outer arris 8*a* of which comes to be located in the plane of the upper surface 9*a* of the receiving plane, in contact with the upper arris of the offset 11.

The conforming jig is left in place while the glue 15 sets. To this end, it may be fixed to the receiving plane by lateral gripping means (not represented) or by applying pressure to the said receiving plane (a press, pneumatic pressure, etc.). At the end of the setting process, a perfect connection between the basin and the receiving plane is obtained, thanks to diffusion of the acrylic glue into the fibres of the fibreboard, and to the continuous weld with the acrylic material of the basin.

After setting, the assembly is turned over and a shoulder of polymerisable resin 19 is cast onto the fillet 14 of the receiving plane, between the latter and the basin, as illustrated in FIG. 8.

The basin has been moulded so that its widened-out portion 6, which, in the example, is frustoconical, extends downwards as far as the level of the fillet 14 when the said basin is in place. The shoulder of resin is cast over the entire circumference, thereby conferring upon the latter a substantially rectangular cross-section, as shown in FIG. 8. The resin used is, in particular, of the acrylic type, in particular one based on PMMA which has been dyed in the compound; it may be placed in position by any means, particularly a gun. Part of the flow escapes into the decompression chamber 18, a fact which makes the operation easier and strengthens the hold of the connection between the receiving plane and the basin.

A finishing operation is then carried out in order to level the joint between the mouth of the basin and the upper surface of the receiving plane. This operation may be performed by a levelling knife, manually or possibly on a numerical machine.

At the end of the operations, a monobloc receiving-plane/basin assembly as illustrated in FIGS. 9 and 10 is obtained. Over its entire circumference, the edge of the opening in the receiving plane is held in a rabbet by the basin between, on the one hand, the mouth of the said basin and, on the other hand, the lower shoulder made of polymerised resin. This non-deformable assembly benefits from a remarkable quality of appearance with perfect continuity of the surface at the level of the joint between the mouth of the basin and the upper surface of the receiving plane. The detail FIG. 11 shows the joint between the basin and the receiving plane at the level of the top part of the assembly. The low thickness of this joint (less than 0.7 mm), the diffusion (symbolised at 20) of the acrylic glue into the fibres of the fibreboard, and the continuity between the set glue and the basin at the level of the surface of the latter (by reason of the welding by surface fusion) contribute to giving the assembly an indissociable monobloc character.

What is claimed is:

1. A method of integrating a basin into a receiving plane, in particular a plane for sanitary fittings or a worktop in a piece of furniture, wherein said method combines the following operations:

(a) the basin is produced by molding a synthetic material, with a peripheral mouth comprising a portion (6) which is widened out towards the top, followed by a rounded portion (7) terminating in an upper rim (8) of centrifugal direction and of predefined diameter, (b) the receiving plane is bored right through and an opening for the insertion of the basin is produced in the said plane, said opening comprising, edgewise:

in its top part, an upper offset (11) matched to the upper rim (8) of the basin and of a height which is suitable for permitting the encasing of the said upper rim of the basin in said upper offset with little clearance, in its intermediate part, a convex rounded formation (12) matched to the rounded portion of the basin so as to be capable of being applied, with little clearance, against the said rounded portion, said convex rounded formation being followed by a decompression section (13), which is arranged to arrive opposite the widened-out portion of the basin so as to form a decompression chamber with said portion, (c) a fine layer of polymerisable glue (15) is deposited at the level of the upper offset (11) and of part of the rounded formation (12) on the receiving plane, (d) the basin is then placed in position in the opening in the receiving plane so that its upper rim (8) and its rounded portion (7) become enchased opposite the upper offset (11) and the rounded formation (12) on the receiving plane respectively, (e) said basin is pushed in, compressing the fine layer of polymerisable glue (15), in such a way that the upper rim (8) of the basin becomes flush with the upper surface **(9*a*) of the receiving plane, the compression having the effect of making the thickness of the polymerisable glue compressed between the matched surfaces thinner and uniform, and being accompanied by a flow of glue towards the decompression chamber (18)** delimited by the widened-out portion of the basin and the decompression section of the receiving plane.

2. A method as claimed in claim 1, wherein the boring of the opening in the receiving plane is carried out so as to endow said opening, in its lower part, with a supporting face (14) for casting a shoulder, the method comprising a final operation (f) consisting in casting a shoulder of polymerisable resin (19) at the level of this supporting face (14), between said supporting face and the basin so as to produce a continuous peripheral connection between these elements, thereby ensuring the caulking thereof over the entire periphery.

3. A method as claimed in claim 2, wherein:

the basin is produced by molding with a substantially frustoconical widened-out portion (6), the opening in the receiving plane is produced so that the lower supporting face (14) is constituted by a peripheral fillet formed at the level of the lower arris of the receiving plane, and that the decompression section (13) is substantially cylindrical for forming, with the basin, the decompression chamber (18) having a bevel-shaped cross-section which broadens out towards the bottom.

4. A method as claimed in claim 3, wherein:

the basin is produced so that its frustoconical widened-out portion (6) extends downwards as far as the level of the fillet (14) on the receiving plane when the said basin is in place, the shoulder of polymerisable resin (19) is cast while conferring upon it a substantially triangular cross-section, with a gap in the resin in the decompression chamber (18).

5. A method as claimed in claim 1, wherein the basin and the opening in the receiving plane are produced in such a way that the upper rim (8) and the rounded portion (7) of the basin have shapes which are matched to those of the offset (11) and of the convex rounded formation (12) on the receiving plane respectively, with a clearance of between 0.1 mm and 0.7 mm.

6. A method as claimed in claim 5, wherein (c) the deposition of the fine layer of polymerisable glue and (e) the pushing-in of the basin are carried out in such a way as to obtain a glue joint with a thickness of less than 0.7 mm.

7. A method as claimed in claim 1, wherein the basin is pushed into the opening in the receiving plane by means of a conforming jig (16) closely following the shape of the upper surface of the basin mouth and of the receiving plane so as to guide the positioning of the basin in the opening in the receiving plane until the upper rim (8) of the basin is flush with the upper surface **(9*a*)** of said receiving plane.

8. A method as claimed in claim 1, wherein, after setting, the joint between the basin and the receiving plane is levelled at the level of the upper surface of said receiving plane.

9. A method as claimed in claims 1, wherein the basin is produced in a thermoplastic material by thermoforming, followed by the machining of its mouth with a view to produce the upper rim (8) with the predefined diameter.

10. A method as claimed in claims 1, wherein the basin is produced by injection molding with a mold having predefined shapes.

11. A method as claimed in claim 1, wherein the basin is moulded from acrylic material, the polymerisable glue (15) and the polymerisable resin of the shoulder (19) being of acrylic material.

12. A method as claimed in claim 11, wherein the receiving plane is made of wood-based fibreboard, having a laminated coating.

13. A monobloc receiving-plane and basin assembly for furniture, in particular bathroom or kitchen furniture, which assembly is manufactured by implementing the method as claimed in claim 1, wherein the receiving plane possesses a lower supporting face (14) and is held in a rabbet by the basin between a peripheral mouth of the latter, said mouth is endowed with a rounded portion (7) and with an upper rim (8) of centrifugal direction, and a lower shoulder (19) of polymerised resin which connects and caulks the basin and the receiving plane over the entire circumference at the bottom part.

14. A monobloc receiving-plane and basin assembly for furniture, in particular bathroom or kitchen furniture, which assembly is manufactured by implementing the method as claimed in claim 1, wherein the basin possesses a peripheral mouth endowed with a rounded portion (7) and with an upper edge (8) of centrifugal direction, wherein the rounded portion (7) and the upper edge (8) of the basin closely follows the upper offset (11) and the intermediate rounded formation (12) on the receiving plane, with an interposed glue joint with a thickness of less than 0.7 mm.

* * * * *